US009134681B2

(12) United States Patent
Ueno

(10) Patent No.: US 9,134,681 B2
(45) Date of Patent: Sep. 15, 2015

(54) IMAGE FORMING APPARATUS

(71) Applicant: KYOCERA Document Solutions Inc., Osaka (JP)

(72) Inventor: Daijiro Ueno, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 14/602,593

(22) Filed: Jan. 22, 2015

(65) Prior Publication Data

US 2015/0212475 A1 Jul. 30, 2015

(30) Foreign Application Priority Data

Jan. 24, 2014 (JP) ..... 2014-011114

(51) Int. Cl.
*G03G 15/00* (2006.01)

(52) U.S. Cl.
CPC ..... *G03G 15/757* (2013.01)

(58) Field of Classification Search
CPC ..... G03G 15/5008; G03G 15/757; G03G 21/186; G03G 2221/1657
See application file for complete search history.

(56) References Cited

U.S. PATENT DOCUMENTS 7,826,773 B2 * 11/2010 Kawamura ..... 399/228
8,126,366 B2 * 2/2012 Hattori ..... 399/167
2014/0294445 A1 * 10/2014 Ueno ..... 399/167

FOREIGN PATENT DOCUMENTS

JP 2005-316283 11/2005

* cited by examiner

*Primary Examiner* — Gregory H Curran
(74) *Attorney, Agent, or Firm* — Wenderoth, Lind & Ponack, L.L.P.

(57) ABSTRACT

A torque transmission mechanism includes a cam member which is rotatably supported and is provided with a cam for pressing a joint member in an axial direction of a rotation shaft and bush which is fitted to the cam member. The bush has an engagement surface with which the cam of the cam member engages. Above mechanism rotates the cam member and moves the cam member along the bush, thereby moving the joint member between an advanced position in which the torque of a drive source is transmitted to a rotary member and a retracted position in which the transmission of the torque of the drive source to the rotary member is released. A rib to which the bush is fitted is formed on an end surface of the cam member existing at a side at which the cam member is fitted to the bush.

4 Claims, 11 Drawing Sheets

IMAGE FORMING APPARATUS

CROSS REFERENCE TO RELATED APPLICATION

This application is based upon and claims the benefit of priority from Japanese Patent Application No. 2014-011114 filed on Jan. 24, 2014, the entire contents of which are incorporated herein by reference.

BACKGROUND

The technology of the present disclosure relates to an image forming apparatus provided with a detachable rotary member.

In an image forming apparatus, there is known a configuration in which a developer including a rotary member such as a developing roller, a stirring paddle or the like and a photosensitive drum are detachably attached to an apparatus body and in which a drive source for rotating the rotary member is installed at the side of the apparatus body. In this configuration, a mechanism for transmitting the torque of the drive source to the rotation shaft of the rotary member mounted to the apparatus body is needed.

As the mechanism for transmitting the torque of the drive source to the rotation shaft of the rotary member, there are available a gear drive transmission system in which a gear installed on a rotation shaft of a rotary member is meshed with a gear installed on a rotation shaft of drive source, and a coaxial drive transmission system in which a rotation shaft of a rotary member is coaxially connected to a rotation shaft of a drive source through the use of a joint member. In recent years, the coaxial drive transmission system becomes a mainstream because the system is capable of saving a space at the side of the rotary member, suppressing generation of heat and matching the phases of gears of a photosensitive drum at the side of the apparatus body.

However, in the coaxial drive transmission system, when the rotary member is attached and detached in a direction orthogonal to the rotation shaft of the drive source, there is needed a configuration for releasing the connection of the rotation shaft of the drive source and the rotation shaft of the rotary member such that the rotation shaft of the rotary member and the rotation shaft of the drive source should not interfere with each other.

An one example of this configuration, there is proposed an image forming apparatus in which a joint member connected to a rotary member is installed on a rotation shaft of a drive source and in which a cam lever having a slant surface engaging with the joint member is provided. This image forming apparatus is configured such that, as the cam lever is moved in a direction orthogonal to the rotation shaft of the drive source, the joint member is moved along the rotation shaft of the drive source between a position where the joint member can be connected to the rotation shaft of the rotary member and a position where the joint member is spaced apart from the rotation shaft of the rotary member.

SUMMARY

An image forming apparatus according to one aspect of the present disclosure includes a rotary member, a drive source and a torque transmission mechanism. The rotary member is detachably supported. The drive source is configured to generate a torque for rotating the rotary member. The torque transmission mechanism is configured to transmit the torque generated by the drive source to the rotary member.

The torque transmission mechanism includes a driving member, a joint member, a biasing member, a cam member and a bush. The driving member is connected to the drive source. The joint member is configured to rotate together with the driving member and configured to be connected to the rotary member by moving in an axial direction of a rotation shaft of the driving member. The biasing member is configured to bias the joint member in the axial direction of rotation shaft. The cam member is supported so as to rotate about the rotation shaft. The cam member is provided with a cam for pressing the joint member in the axial direction of the rotation shaft. The bush is fitted to the cam member. The bush is provided with an engagement surface with which the cam of the cam member engages. The torque transmission mechanism is configured to rotate the cam member and to move the cam member along the bush in the axial direction of the rotation shaft such that the joint member is moved in the axial direction of the rotation shaft between an advanced position and a retracted position. In the advanced position, the joint member is connected to the rotary member to transmit the torque of the drive source to the rotary member. In the retracted position, the joint member is spaced apart from the rotary member to release transmission of the torque of the drive source to the rotary member. A rib to which the bush is fitted is formed on an end surface of the cam member existing at a side at which the cam member is fitted to the bush.

DETAILED DESCRIPTION

An image forming apparatus according to an embodiment will now be described with reference to the accompanying drawings.

Figure 1:
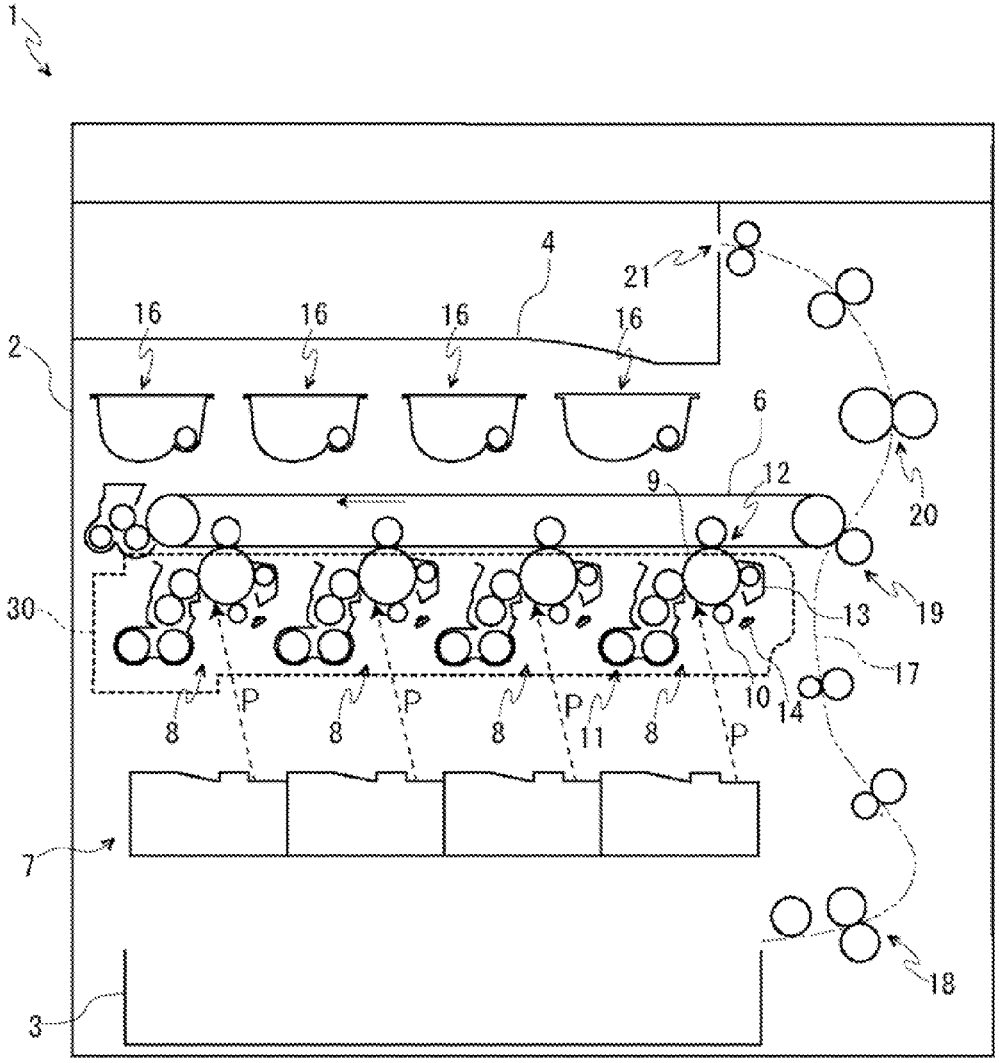
FIG. 1 is a front view schematically showing an overall configuration of a color printer according to an embodiment.

First, an overall configuration of a color printer 1 (an image forming apparatus) will be described with reference to FIG. 1. FIG. 1 is a front view schematically showing the overall configuration of the color printer. The front side in FIG. 1 will be referred to as the front side of the color printer. The left-right direction will be described based on the direction seen from the front side of the color printer.

The color printer 1 includes a box-shaped printer body 2. A sheet feed cassette 3 which accommodates sheets (recording media) is installed in the lower portion of the printer body 2. A sheet discharge tray 4 is installed in the upper portion of the printer body 2.

In the central portion of the interior of the printer body 2, an intermediate transfer belt 6 is installed between rollers. An exposure device 7 configured by laser scanning units (LSUs) is disposed below the intermediate transfer belt 6. At the lower side of the intermediate transfer belt 6, four image forming units 8 are installed in a corresponding relationship with toner colors (e.g., four colors of magenta, cyan, yellow and black). A photosensitive drum 9 rotatably installed in each of the image forming units 8. Around the photosensitive drum 9, a charger 10, a developer 11, a primary transfer unit 12, a cleaning device 13 and a discharger 14 are disposed in the order of primary transfer processes. A rotation shaft is installed in the developer 11. The rotation shaft is connected to a developing roller, a stirring paddle or the like through a gear. If the rotation shaft rotates, the developing roller, the stirring paddle or the like as a rotary member is rotated in a predetermined direction.

As shown in FIG. 1, the rotation shaft of the photosensitive drum 9 and the rotation shaft of the developer 11 are respectively disposed so as to extend in the front-rear direction of the printer body 2. Furthermore, the developer 11 and the photosensitive drum 9 are attached to or detached from each of the image forming units 8 from the upper side of the printer body 2 which is a direction orthogonal to the rotation shafts of the developer 11 and the photosensitive drum 9. It can be said that the rotary member such as the developing roller, the stirring paddle or the like is a component of the developer 11 and is attachable or detachable with respect to each of the image forming units 8.

The photosensitive drum 9 and the developer 11 are driven by a drive unit 30. The drive unit 30 is disposed so as to correspond to the four image forming units 8. At the upper side of the developer 11, toner containers 16 corresponding to the respective image forming units 8 are accommodated side by side along the left-right direction in a corresponding relationship with the toner colors.

At the right side of the interior of the printer body 2, there is installed a sheet conveyance route 17 vertically extending from the sheet feed cassette 3 toward the sheet discharge tray 4. A sheet feed unit is installed at the upstream end of the sheet conveyance route 17. In the midstream region of the sheet conveyance route 17, a second transfer unit 19 is installed at one end (the right end in FIG. 1) of the intermediate transfer belt 6. A fixing device 20 is installed in the downstream region of the sheet conveyance route 17. A sheet discharge hole 21 is installed at the downstream end of the sheet conveyance route 17.

Next, description will be made on an image forming operation of the color printer 1 provided with this configuration. If electric power is supplied to the color printer 1, various kinds of parameters are initialized and initial setting such as setting of the temperature of the fixing device 20 or the like is executed. Then, if image data are inputted from a computer connected to the color printer 1 and if a print start instruction is issued, an image forming operation is performed as follows.

First, the surface of the photosensitive drum 9 is charged by the charger 10. Thereafter, an electrostatic latent image is formed on the surface of the photosensitive drum 9 by laser beams (see arrows P) irradiated from the exposure device 7. Then, the electrostatic latent image is developed into a toner image of a corresponding color by the developer 11 using the toners supplied from the toner containers 16. The toner image is primarily transferred to the surface of the intermediate transfer belt 6 to the primary transfer unit 12. As the above operation is sequentially repeated by the respective image forming units 8, a full-color toner image is formed on the intermediate transfer belt 6. The toners and the electric charges remaining on the photosensitive drum 9 are removed by the cleaning device 13 and the discharger 14.

In the meantime, the sheet taken out from the sheet feed cassette 3 conveyed to a secondary transfer unit 19 at the timing matched with the aforementioned image forming operation. In the secondary transfer unit 19, the full-color toner image on the intermediate transfer belt 6 is secondarily transferred to the sheet. The sheet, to which the toner image is secondarily transferred, is conveyed toward the downstream side of the sheet conveyance route 17 and enters the fixing device 20. In the fixing device 20, the toner image is fixed to the sheet. The sheet, to which the toner image is fixed, is discharged from the sheet discharge hole 21 onto the sheet discharge tray 4.

Figure 2:
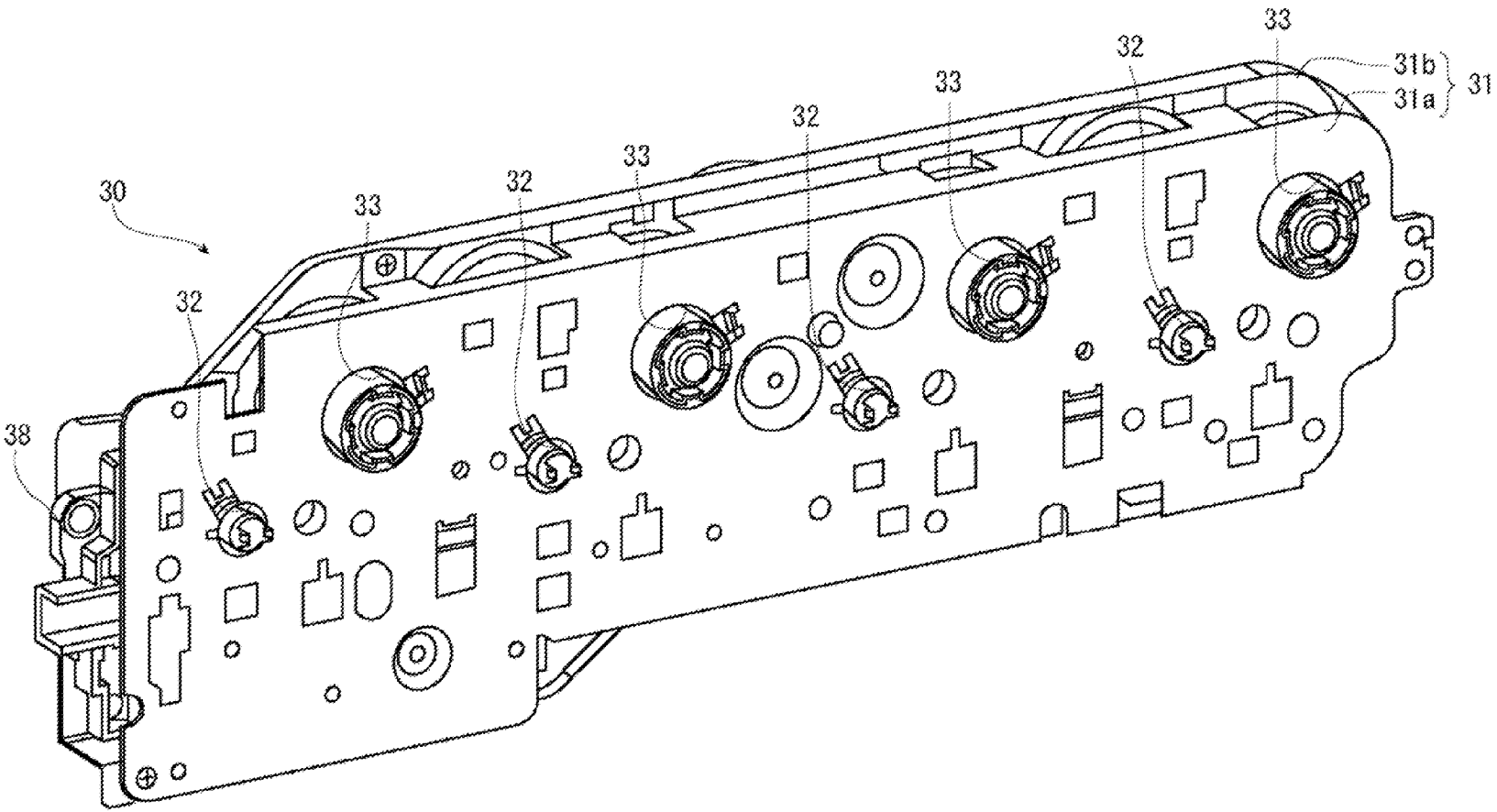
FIG. 2 is a perspective view showing a torque transmission state of a drive unit of the color printer according to the embodiment.
Figure 3:
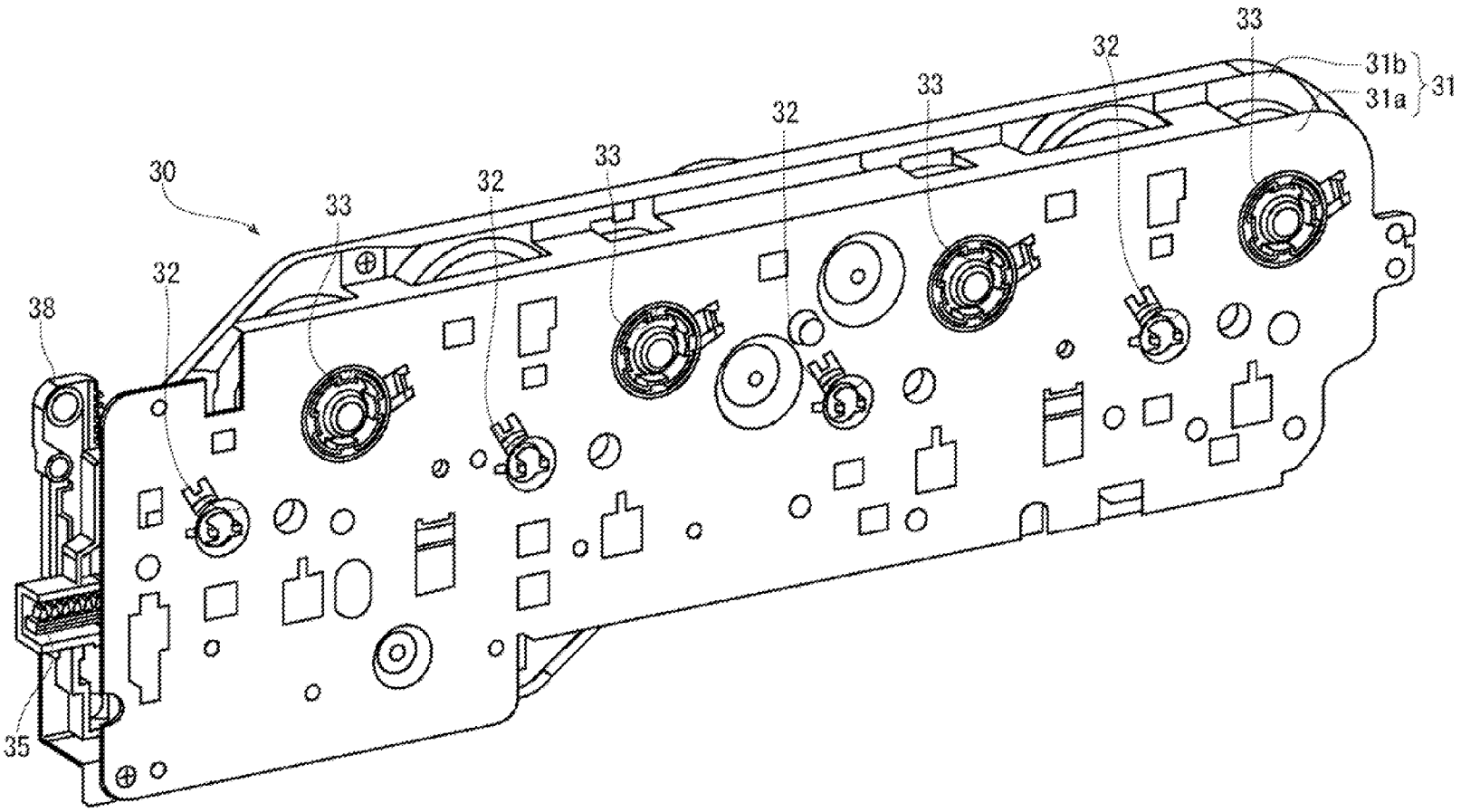
FIG. 3 is a perspective view showing a torque transmission release state of the drive unit of the color printer according to the embodiment.
Figure 4:
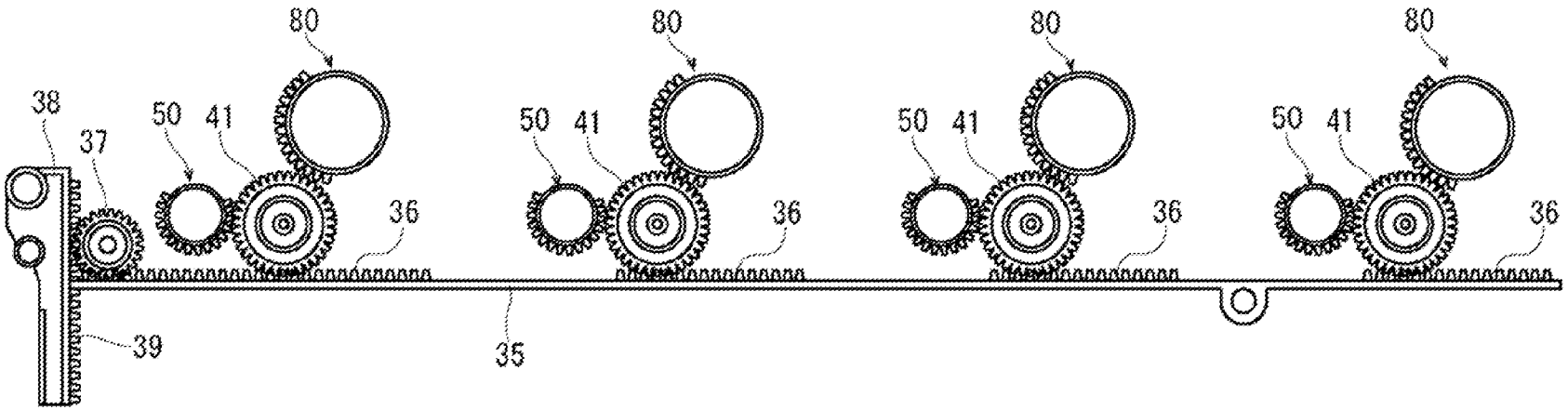
FIG. 4 is a front view showing the interior of the drive unit kept in the torque transmission state in the color printer according to the embodiment.
Figure 5:
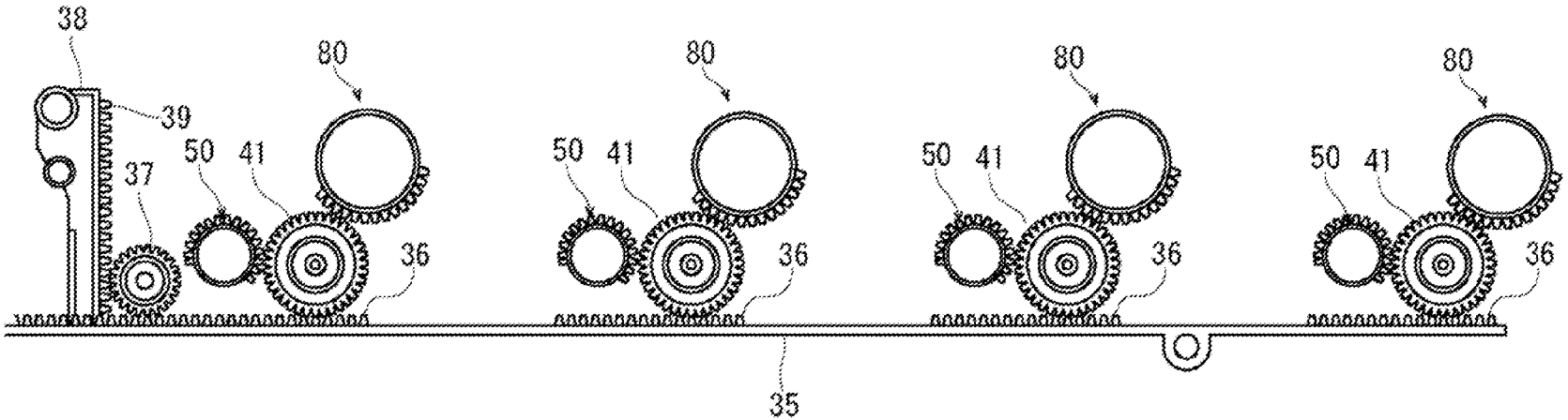
FIG. 5 is a front view showing the interior of the drive unit kept in the torque transmission release state in the color printer according to the embodiment.

Next, the drive unit 30 will he described with reference to FIGS. 2 to 5. FIG. 2 is a perspective view showing a torque transmission state of the drive unit. FIG. 3 is a perspective view showing a torque transmission release state of the drive unit. FIG. 4 is a front view showing the interior of the drive unit kept in the torque transmission state. FIG. 5 is a front view showing the interior of the drive unit kept in the torque transmission release state.

As shown in FIGS. 2 and 3, the drive unit 30 includes a rectangular sold housing 31 which is flat in the front-rear direction and which is long in the horizontal direction. The housing 31 is formed of an inner plate 31*a* and an outer plate 31*b*, both of which have a substantially rectangular shape elongated in the horizontal direction. Circular openings 32 and 33 are formed in the inner plate 31*a* at the positions respectively corresponding to the rotation shafts of the developers 11 and the rotation shafts of the photosensitive drums 9 of the respective image forming units 8. The openings 33 formed at the positions corresponding to the photosensitive drums 9 are larger in diameter than the openings 32 formed at the positions corresponding to the developers 11. In addition, openings and connectors for connecting power supply lines and signal lines to the image forming units 8 are formed or installed in the inner plate 31*a*.

As shown in FIGS. 4 and 5, a movable bar 35 extending in the left-right direction is supported within the housing 31 such that the movable bar 35 can reciprocate in the left-right direction. Rack gears 36 are formed in the movable bar 35 at the positions corresponding to the respective image forming units 8. At the left end of the interior of the housing 31, there are disposed a pinion gear 37 which meshes with the rack gear 36 formed at the leftmost end of the movable bar 35 and a lever member 38 which rotates the pinion gear 37. The lever member 38 is a vertically-elongated plate-shaped member and is supported such that the lever member 38 can reciprocate in the up-down direction. A rack gear 39 meshing with the pinion gear 37 is formed on the right side surface of the lever member 38. If the lever member 38 is moved in the up-down direction, the movable bar 35 is moved in the left-right direction through the pinion gear 37. Within the housing 31, there is also disposed a gear train which meshes with a rotation shaft of a drive source (not shown) such as a motor or the like.

Within the housing 31, idle gears 41 meshing with the rack gears 36 of the movable bar 35 are rotatably supported at the positions corresponding to the respective image forming units 8. At the positions respectively corresponding to the rotation shaft of the developer 11 and the rotation shaft of the photosensitive drum 9 of each of the image forming units 8, a torque transmission mechanism 50 for transmitting the torque generated by the drive source to the rotation shaft of the developer 11 and a torque transmission mechanism 80 for transmitting the torque generated by the drive source to the rotation shaft of the photosensitive drum 9 are disposed so as to be exposed from the respective openings 32 and 33 of the inner plate 31*a* (see FIGS. 2 and 3).

Figure 6:
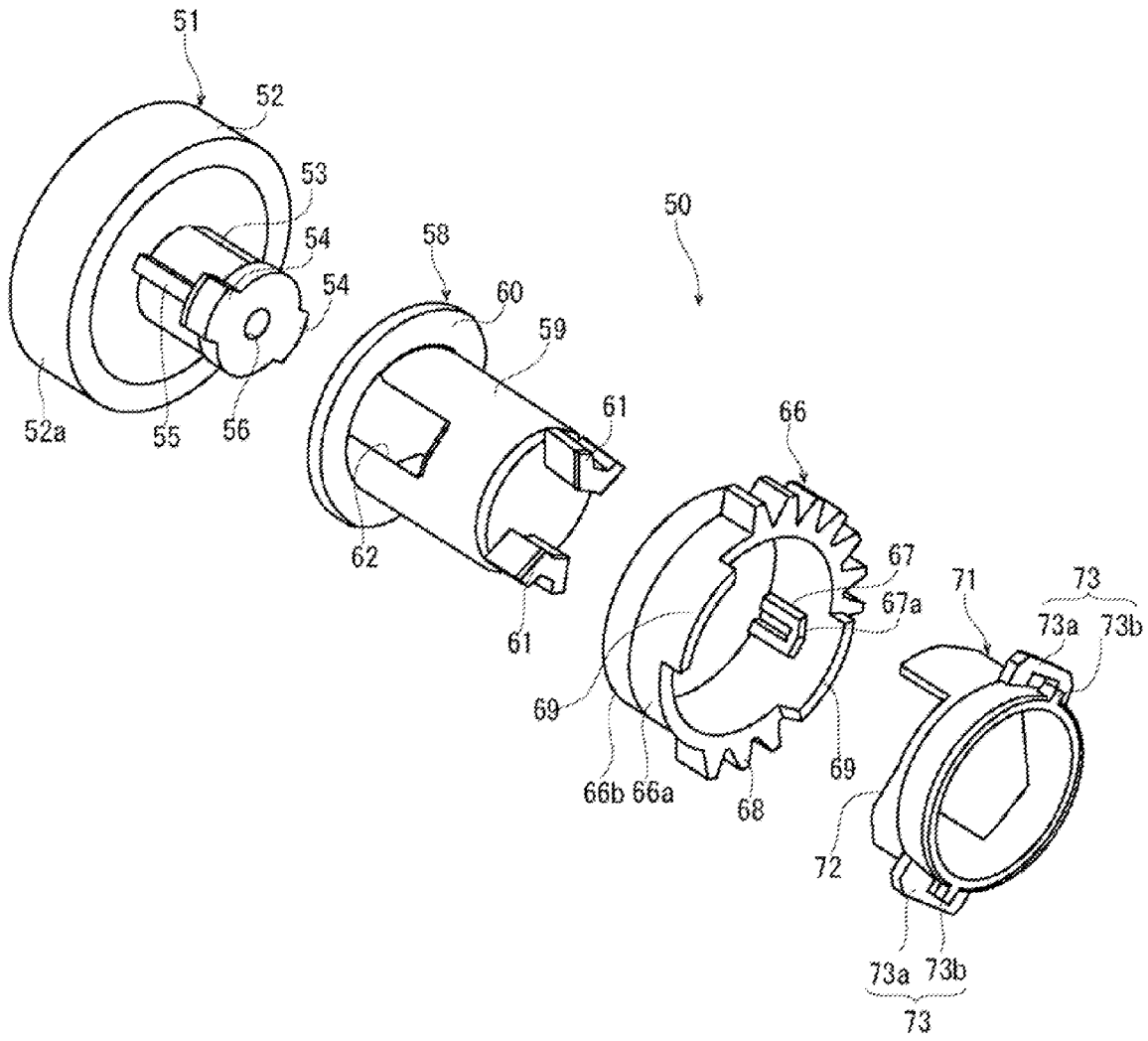
FIG. 6 is an exploded perspective view showing a configuration of a torque transmission mechanism of a developer in the color printer according to the embodiment.
Figure 7:
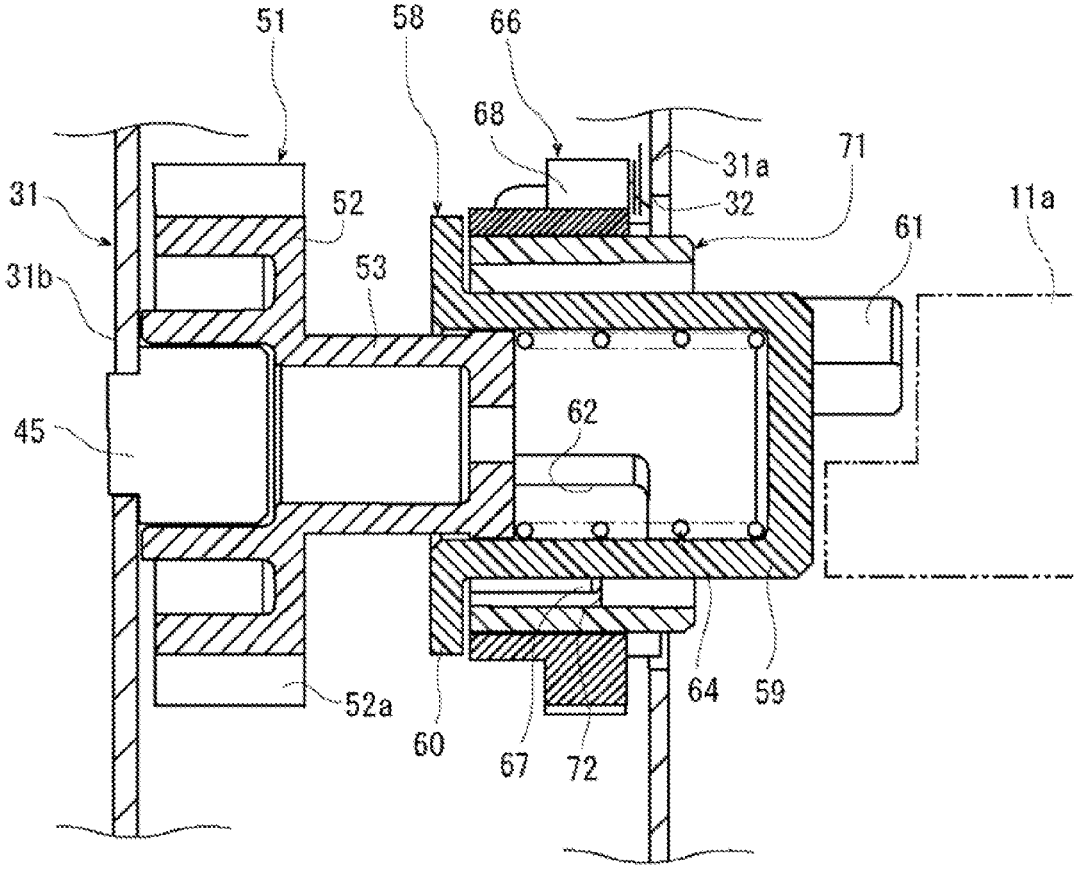
FIG. 7 is a side sectional view showing a torque transmission state of the torque transmission mechanism in the color printer according to the embodiment.
Figure 8:
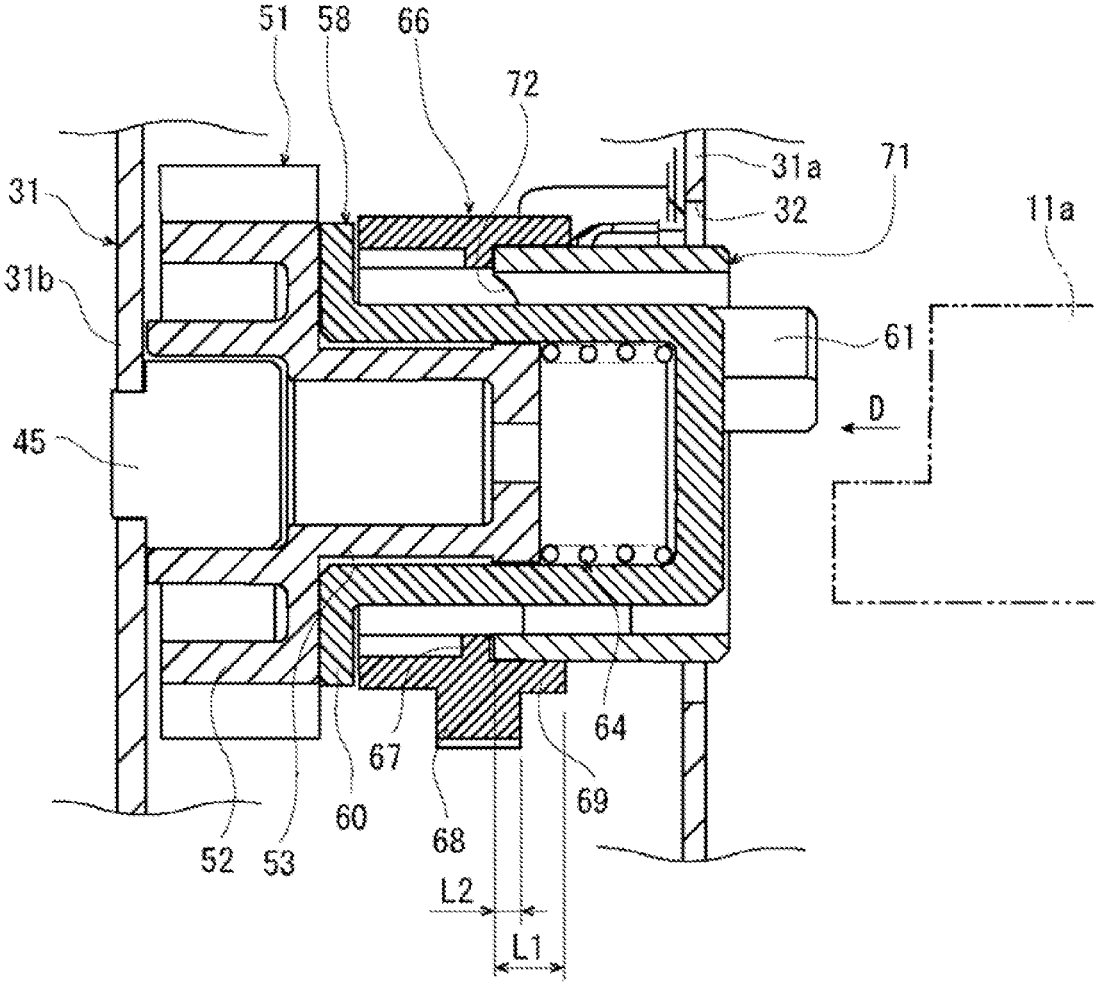
FIG. 8 is a side sectional view showing a torque transmission release state of the torque transmission mechanism in the color printer according to the embodiment.
Figure 9:
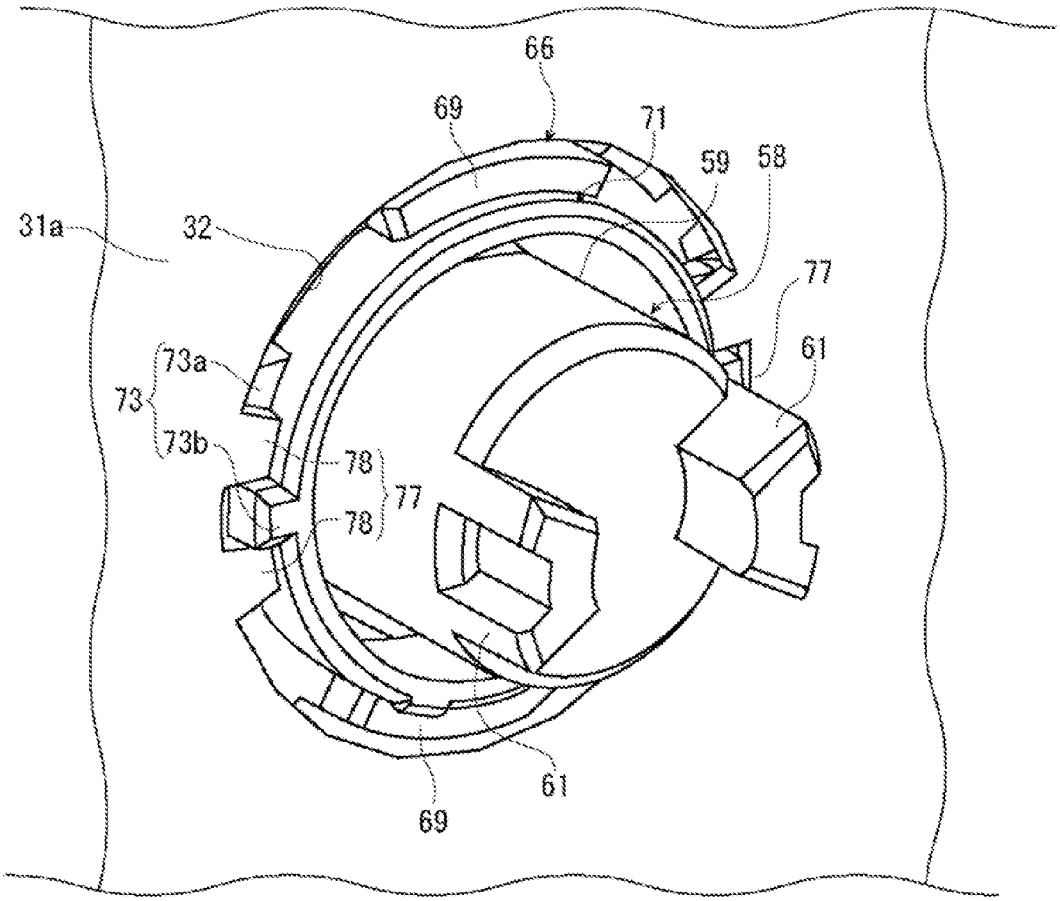
FIG. 9 is a perspective view showing a state in which the torque transmission mechanism is attached to a housing in the color according to the embodiment.

Next, the torque transmission mechanism 50 for transmitting the torque to the rotation shaft of the developer 11 will be described with reference to FIGS. 6 to 9. FIG. 6 is an exploded perspective view showing the configuration of the torque transmission mechanism of the developer. FIG. 7 is a side sectional view showing a torque transmission state of the torque transmission mechanism. FIG. 8 is a side sectional view showing a torque transmission release state of the torque transmission mechanism. FIG. 9 is a perspective view showing a state in which the torque transmission mechanism is attached to the housing.

As shown in FIG. 6, the torque transmission mechanism 50 includes a diving gear (or a driving member) 51 rotated by a drive source, a joint member 58 connectable to a joint portion installed in the rotation shaft of the developer 11, a coil spring (or a biasing member) 64 (not shown in FIG. 6) for biasing the joint member 58 toward the joint portion of the developer 11, a cam member 66 for pressing the joint member 58 in the axial direction of the rotation shaft of the drive source, and a bush 71 with which the cam member 66 makes contact.

The driving gear 51 includes a disc-shaped gear portion 52 and a shaft portion 53 protruding forward from the center of the gear portion 52. The interior of the driving gear 51 is hollow. A gear 52*a* is formed on the outer circumference of the gear portion 52. Engagement portions 54 radially protruding from the diagonal positions with respect to the axis of the shaft portion 53 are formed on the front end surface of the shaft portion 53. Linear projection portions 55 extending from the respective engagement portions 54 in the axial direction of the shaft portion 53 are formed on the outer circumferential surface of the shaft portion 53. A circular opening 56 is formed at the center of the end surface of the shaft portion 53.

The joint member 58 is a cylindrical member externally fitted to the shaft portion 53 of the driving gear 51. The joint member 58 includes a cylindrical portion 59 whose front end is closed and an annular flange portion 60 protruding radially outward from the rear end surface of the cylindrical portion 59. Engagement portions 61 protruding forward are diagonally formed on the front end surface of the cylindrical portion 59. The engagement portions 61 have a substantially trapezoidal shape when seen in front view. The engagement portions 61 are formed so as to engage with the joint portion installed in the rotation shaft of the developer 11. Rectangular slots 62 extending in the front-rear direction are diagonally formed on the side surface of the cylindrical portion 59. As the engagement portions 54 engage with the respective slots 62, the joint member 58 can unitarily rotate together with the driving gear 51 and can move in the extension direction of the slots 62, namely in the front-rear direction.

The coil spring 64 is retained between the front end surface of the shaft portion 53 of the driving gear 51 and the front end surface of the cylindrical portion 59 of the joint member 58. The coil spring 64 biases the joint member 58 forward with respect to the driving gear 51.

The cam member 66 is a cylindrical member loosely fitted the cylindrical portion 59 of the joint member 58 and is formed such that the rear end surface of the cam member 66 makes contact with the front surface of the flange portion 60 of the joint member 58. The outer diameter of the cam member 66 is changed at two stages along the front-rear direction. The cam member 66 includes a front portion 66*a* having a large outer diameter and a rear portion 66*b* having a small outer diameter. The inner diameter of the cam member 66 is made uniform along the front-rear direction. Cams 67 are formed at the diagonal positions of the inner circumferential surface of the cam member 66. The cams 67 are formed so as to protrude radially inward from the inner circumferential surface of the cam member 66. Each of the cams 67 is formed into a substantially U-like shape such that each of the cams 67 extends from the rear end of the inner circumferential surface of the cam member 66 to a position near the front end thereof and then turns back toward the rear end. A taper surface 67*a* is formed on the front end surface of each of the cams 67.

A gear 68 is formed in a substantially ⅓region of the outer circumferential surface of the front portion 66*a*. The gear 68 is configured to mesh with one of the idle gears 41 (see FIGS. 4 and 5). Ribs 69 protruding forward are formed on the front end surface of the front portion 66*a* at two diagonal positions. The ribs 69 are disposed at the positions corresponding to the respective cams 67 in the circumferential direction of the cam member 66 and are formed into an arc shape when seen in a front view, so as to extend along the circumference of the cam member 66.

The bush 71 is a cylindrical member fitted to the cam member 66. Slant surfaces (engagement surfaces) 72 with which the taper surfaces 67*a* of the front end surfaces of the respective cams 67 of the cam member 66 make contact are formed on the rear end surface of the bush 71 such that each of the slant surfaces 72 grows deeper from the rear end of the bush 71 toward the front side. The inclination angle of the slant surfaces 72 is substantially equal to the inclination angle of the taper surfaces 67*a* of the cams 67. Positioning portions 73 to be positioned in the housing 31 are diagonally formed at the positions near the front end of the outer circumferential surface of the bush 71. Each of the positioning portions 73 includes a flat portion 73*a* protruding in a substantially semi-circular shape along the circumferential direction and a lug portion 73*b* formed near the center of the front surface of the flat portion 73*a* in the circumferential direction.

As shown in FIGS. 7 and 8, the torque transmission mechanism 50 having the aforementioned configuration is positioned in one of the openings 32 formed in the inner plate 31*a* of the housing 31 and is disposed between the inner plate 31*a* and the outer plate 31*b*.

Bearing portions 45 are installed on the inner surface of the outer plate 31*b* of the housing 31. The gear portion 52 of the driving gear 51 is fitted to one of the bearing portions 45. The gear portion 52 is operatively connected to the rotation shaft of the drive source such as a motor or the like through a speed reducer or a gear train (not shown). If the drive source is driven, the driving gear 51 can rotate around one of the bearing portions 45. The joint member 58 is fitted to the shaft portion 53 of the driving gear 51 through the coil spring 64.

The engagement portions 54 of the shaft portion 53 engage with the respective slots 62 of the cylindrical portion 59 of the joint member 58.

The bush 71 is fitted to the cam member 66. The taper surfaces 67*a* of the cams 67 of the cam member 66 engage with the slant surfaces 72 of the bush 71. The bush 71 is loosely fitted to the cylindrical portion 59 of the joint member 58 in such a state that the bush 71 is fitted to the cam member 66. As shown in FIG. 9, the bush 71 is positioned in one of the openings 32 of the inner plate 31*a* of the housing 31. In one of the openings 32 of the inner plate 31*a* of the housing 31, there are formed projection portions 77 in which the respective positioning portions 73 of the bush 71 are positioned. Each of the projection portions 77 includes a pair of projections 78 protruding radially inward from inner circumferential surface of one of the openings 32. The projection portions 77 are formed at the diagonal positions of one the openings 32. If the bush 71 is inserted into one of the openings 32 at the inner side of the inner plate 31*a*, the flat portions 73*a* of the positioning portions 73 of the bush 71 are locked on the rear surfaces of the projection portions 77 while the lug portion 73*b* are located between the projections 78. Thus, the bush 71 is locked in the inner plate 31*a* such that it cannot move forward and cannot rotate. When the bush 71 is positioned in one of the openings 32 of the inner plate 31*a*, the first end portion of the bush 71 is overhung forward from the inner plate 31*a*. In addition, the cam member 66 meshes with one of the idle gears 41.

The joint member 58 is biased by the coil spring 64 such that the engagement portions 61 protrude forward from one of the openings 32 of the inner plate 31*a*. The front surface of the flange portion 60 makes contact with the rear end surface of the cam member 66.

Figure 10:
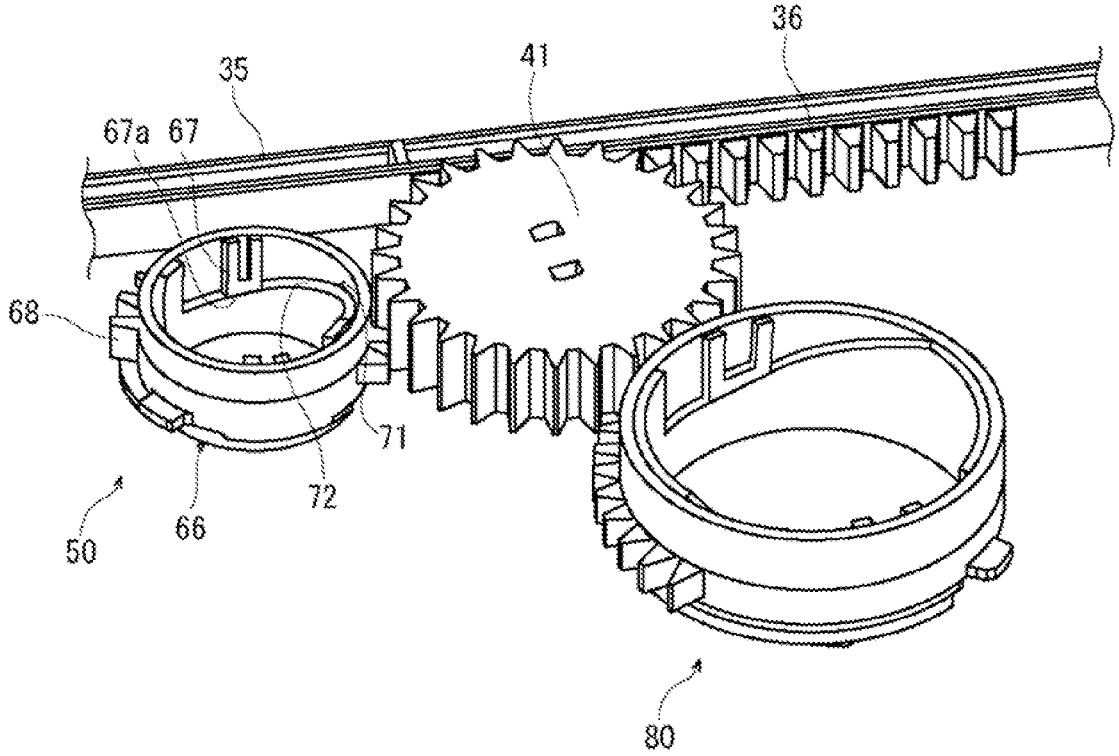
FIG. 10 is a perspective view showing a cam member and a bush in the torque transmission state in the color printer according to the embodiment.
Figure 11:
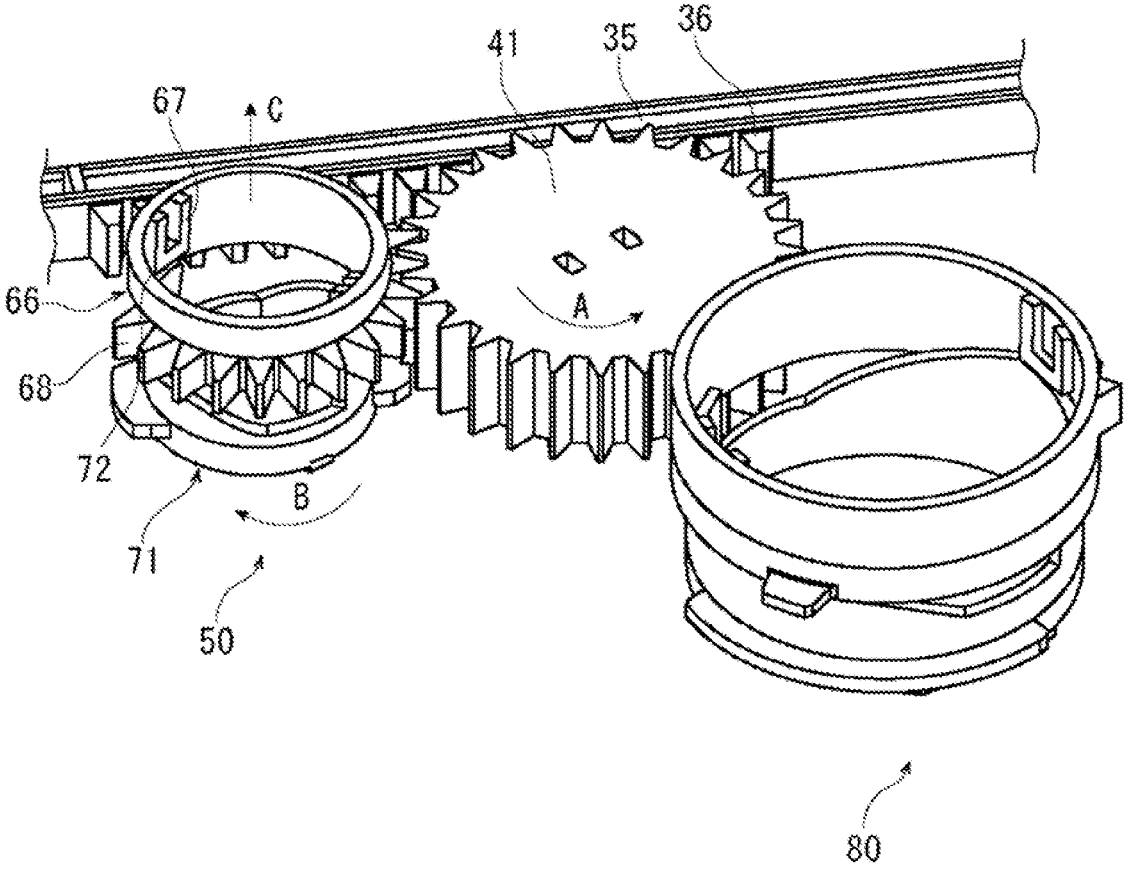
FIG. 11 is a perspective view showing the cam member and the bush in the torque transmission release state in the color printer according to the embodiment.

Next, a torque transmission operation and a torque transmission release operation performed by the torque transmission mechanism 50 will be described with reference to FIGS. 7 and 8 and FIGS. 10 and 11. FIG. 10 is a perspective view showing the cam member and the bush in the torque transmission state. FIG. 11 is a perspective view showing the cam member and the bush in the torque transmission release state. In FIGS. 10 and 11, the downward direction indicates the front side of the printer body, and the upward direction indicates the side of the printer body. Furthermore, in FIGS. 10 and 11, there are illustrated only the cam member and the bush of the torque transmission mechanism.

In the torque transmission state shown in FIG. 7, the taper surfaces 67*a* of the cam 67 of the cam member 66 make contact with the positions near the deepest regions of the slant surfaces 72 of the bush 71 (See FIG. 10). In other words, the cam member 66 is located at the most front position on the outer surface of the bush 71. The joint member 58 is biased forward by the coil spring 64 until the front surface of the flange portion 60 comes into contact with the rear end surface of the cam member 66. The joint member 58 is moved forward to the position where the engagement portions 61 of the joint member 58 can engage with the joint portion 11*a* installed in the rotation shaft of the developer 11. If the driving gear 51 is rotated in such a state that the joint portion 11*a* of the rotation shaft of the developer 11 and the joint member 58 engage with each other, the joint member 58 is unitarily rotated together with the driving gear 51, thereby rotating the rotation shaft of the developer 11 which engages with the joint member 58. That is to say, the torque of the drive source is transmitted to the rotation shaft of the developer 11, thereby rotating the developing roller, the stirring paddle or the like.

When releasing the torque transmission, the lever member 38 (see FIGS. 4 and 5) of the housing 31 is pulled upward to move the movable bar 35 in the left direction, thereby rotating the idle gears 41. As shown in FIG. 11, if one of the idle gears 41 is rotated (see an arrow A in FIG. 11), the cam member 66 meshing with one of the idle gears 41 is rotated (see an arrow B in FIG. 11), during which time the inner surface of the cam member 66 makes sliding contact with the outer circumferential surface of the bush 71. The taper surfaces 67*a* of the cams 67 of the cam member 66 are moved in the direction in which the depth of the slant surfaces 72 of the bush 71 becomes shallow. That is to say, as shown in FIGS. 8 and 11, the cam member 66 is moved backward and the flange portion 60 of the joint member 58 is pressed backward by the rear end surface of the cam member 66. Thus, the joint member 58 is axially moved backward along the slots 62 against the biasing force of the coil spring 64 (see an arrow C in FIG. 11 and an arrow D in FIG. 8). As shown in FIG. 8, the joint member 58 is moved backward until the flange portion 60 makes contact with the front surface of the gear portion 52 of the driving gear 51. In this state, the engagement portions 61 of the joint member 58 are completely spaced apart from the joint portion 11*a* of the developer 11, whereby the transmission of the torque of the drive source is released.

At this time, as shown in FIGS. 8 and 11, the taper surfaces 67*a* of the cams 67 of the cam member 66 are moved in the direction in which the depth of the slant surfaces 72 of the bush 71 becomes shallow. The height of the region over which the cam member 66 and the bush 71 overlap with each other in the front-rear direction (the overlapping amount) becomes smallest. However, ribs 69 protruding forward are formed in the cam member 66. Therefore, in the region of the ribs 69, the overlapping amount of the cam member 66 and the bush 71 in the front-rear direction becomes larger.

According to the color printer 1 of the present embodiment, when releasing the torque transmission, even if the taper surfaces 67*a* of the cams 67 of the cam member 66 are moved in the direction (the backward direction) in which the slant surfaces 72 of the bush 71 become shallow, the overlapping amount L1 of the cam member 66 and the bush 71 in the front-rear direction is made larger, due to the ribs 69 of the cam member 66, than the overlapping amount L2 obtained when the ribs 69 is not formed. This makes it possible to secure a sufficient overlapping amount. Accordingly, the cam member 66 and bush 71 can be stably brought into engagement with each other. It is therefore possible to reliably transmit the torque and to reliably release the torque transmission. It is also possible to increase the displacement amount of the joint member 58 within the same space as that of the prior art.

In the present embodiment, the ribs 69 are formed at the positions corresponding to the respective cams 67 formed in the cam member 66. However, the ribs 69 may be formed over the entire circumference of the front end surface of the cam member 66.

The ribs 69 may be formed such that, when the cam member 66 Is moved to the most front position, the front ends of the ribs 69 protrude forward from the inner plate 31*a* of the housing 31. By forming the ribs 69 in this way, it is possible to further increase the overlapping amount of the cam member 66 and the bush 71. However, the protruding height of the ribs 69 from the inner plate 31*a* is set such that, when attaching and detaching the developer 11, the ribs 69 do not interfere with the rotation shaft of the developer 11.

In the present embodiment, the developer 11 can be attached or detached in the direction orthogonal to the extension direction of the rotation shaft of the drive source. That is to say, there is no need to move the developer 11 in the extension direction of the rotation shaft and to connect the developer 11 to the rotation shaft of the drive source after the developer 11 is mounted to the printer body 2. This makes it possible to reduce the size of the printer body 2 in the extension direction of the rotation shaft of the drive source, namely in the front-rear direction.

The torque transmission mechanism 50 of the present embodiment can be applied to the torque transmission mechanism 80 for the rotation shaft of the photosensitive drum 9. In addition, the rotary includes a process cartridge obtained by unifying at least one of the photosensitive drum 9, the developer 11, the charger 10 and the cleaning device 13 into a cartridge.

In the present embodiment, there has been described a case where the image forming apparatus is the color printer 1. In other embodiments, the image forming apparatus may be a copier, a facsimile machine, a multifunction peripheral, and so forth.

Since the foregoing description of the present embodiment is directed to preferred embodiment, there may be a case where various kinds of technically desirable limitations are added thereto. However, the technology of the present disclosure is not particularly limited to the aforementioned embodiment. That is to say, the components of the present embodiment may be appropriately replaced by existing components or may be combined with other existing components. The contents recited in the claims shall not be limited by the description of the present embodiment.

What is claimed is:

1. An image forming apparatus, comprising:

a detachably supported rotary member;

a drive source configured to generate a torque for rotating the rotary member; and a torque transmission mechanism configured to transmit the torque generated by the drive source to the rotary member, wherein the torque transmission mechanism includes a driving member connected to the drive source, a joint member configured to rotate together with the driving member and configured to be connected to the rotary member by moving in an axial direction of a rotation shaft of the driving member, a biasing member configured to bias the joint member in the axial direction of the rotation shaft, a cam member provided with a cam for pressing the joint member in the axial direction of the rotation shaft, and supported so as to rotate about the rotation shaft, and a bush provided with an engagement surface with which the cam of the cam member engages, and fitted to the cam member, the torque transmission mechanism is configured to rotate the cam member and to move the cam member along the bush in the axial direction of the rotation shaft such that the joint member is moved in the axial direction of the rotation shaft between an advanced position where the joint member is connected to the rotary member to transmit the torque of the drive source to the rotary member and a retracted position where the joint member is spaced apart from the rotary member to release transmission of the torque of the drive source to the rotary member, and a rib to which the bush is fitted is formed on an end surface of the cam member existing at a side at which the cam member is fitted to the bush.

2. The image forming apparatus of claim 1, wherein, in the cam member, the rib is formed so as to protrude from a front end surface of the cam member including a circumferential position at which the cam is formed.

3. The image forming apparatus of claim 1, wherein, in the cam member, the rib is formed so as to protrude toward the rotary member away from a housing to which the torque transmission mechanism is attached.

4. The image forming apparatus of claim 1, wherein the rotary member is attachable or detachable in a direction orthogonal to a rotation shaft of the drive source.

* * * * *